United States Patent [19]

Read et al.

[11] 4,237,000

[45] Dec. 2, 1980

[54] SHAKER ASSEMBLY FOR SCREENING AND SCALPING

[75] Inventors: James L. Read; William K. Morgan, both of Halifax, Mass.

[73] Assignee: F. T. Read & Sons, Inc., Rockland, Mass.

[21] Appl. No.: 17,757

[22] Filed: Mar. 5, 1979

[51] Int. Cl.[3] ..... B07B 1/48

[52] U.S. Cl. ..... 209/319; 209/395; 209/420

[58] Field of Search ..... 209/420, 421, 412, 413, 209/405, 408, 403, 319, 315, 311, 395, 399, 393, 401

[56] References Cited

U.S. PATENT DOCUMENTS

| | | | |
|---|---|---|---|
| 1,510,742 | 10/1924 | Gutleben | 209/420 |
| 1,806,934 | 5/1931 | Deister | 209/420 X |
| 1,920,972 | 8/1933 | Deister | 209/403 X |
| 2,374,775 | 5/1945 | Parks | 209/395 |

OTHER PUBLICATIONS

1977–1978 Pit and Quarry Handbook Buyer's Guide, Pit and Quarry Publ. Inc., Chic., Ill. pp. B144 & B145.

*Primary Examiner*—Ralph J. Hill

*Attorney, Agent, or Firm*—Hamilton, Brook, Smith & Reynolds

[57] ABSTRACT

Relatively fine materials are separated from bulky materials by a two-tier screen assembly mounted on springs and shaken by an off balance drive. The screen assembly spans the space between two parallel plates which are joined by staggered crossbeams. An upper screen is supported by longitudinal bars which rest across upper crossbeams, and two lower screens rest on lower crossbeams. The crossbeams are joined by a longitudinal center plate. In use, the forces of heavy weights tending to bend a given crossbeam are transmitted through the center plate to the joined crossbeams to reduce the strain on the single beam.

4 Claims, 7 Drawing Figures

32
18
24
70
40
40
4
36
16
34
4
14
28
12
30
22
26
20
36

32
40
62
62
24
62
40
38
44
56
22
68
42B
42A
72
28
14
52A
26
54
86
84
76
80
30
20

16
70
66
62
62
40
38
62
62
24
64
68
14
72
51
99
74
90
34
92
51
94
98
82
78
28
58B
50B
86
84
88
50A
26
76
80
96
100
36
30
58A

SHAKER ASSEMBLY FOR SCREENING AND SCALPING

BACKGROUND OF THE INVENTION

This invention relates to screening apparatus for separating relatively fine material from coarse material and more particularly to a shaker screen assembly for such an apparatus which is able to receive exceptionally heavy materials.

In many separators known in the art, gravel or the like is laid across a vibrating shaker screen. The screen has a mesh size suitable for passing particles of a predetermined size therethrough while supporting and carrying larger particles to a chute, conveyor or the like. As a rule of thumb, it is generally stated that the downwardly sloping length of the shaker screen should be about two and a half times the width of the screen in order to maximize the separating rate and the quality of separation while keeping the separator to a reasonable size. Such separators generally require hoppers at the input end of the shaker screen to funnel the particles onto the screen. One or more output chutes or conveyors are also generally required to carry the separated material away from the shaker screen.

Shaker screens are generally sturdy enough to handle gravel and to separate the gravel from loam and the like. However, large rocks and stumps which would destroy the screens must be separated by a scalper or feeder. The scalper includes heavy bars spaced close enough to feed large rocks to a crusher. Gravel, loam and the like pass through the scalper bars to a conveyor for transfer to the shaker screen.

Rich soil, or loam, is presently high in demand. Due to many regional restrictions on excavating, however, those who supply loam must often go to remote locations that offer rough top soil and separate the loam from coarse material such as rocks, gravel, decaying root stumps and so on. In order to avoid having to transport both the loam and the coarse material, it is highly desirable that a portable apparatus be used for separating the loam from the coarse material. To this end, many past shaker screen separators mounted on a truck or trailer have been reduced-scale imitations of stationary separator plants. Such separators generally require a conveyor or chutes to carry the separated loam and coarse material away from the shaker screen. Also, because of the extended lengths and reduced widths of these shaker screen separators, the separators require infeed hoppers or conveyors. Unless scalpers have been incorporated into the plants, these separators have not been reliable in separating loam from extremely bulky material, such as root stumps and the like, which have clogged the hoppers or conveyors.

In my copending patent application, Ser. No. 947,380, filed Oct. 2, 1978, for a Loan Screening Apparatus, I disclosed a shaker screen apparatus having a generally square shaker screen assembly. That apparatus has been used successfully to receive very bulky, heavy material such as tree stumps to separate that heavy material from finer loam. Except for the width of that screening assembly relative to its length, the screening assembly mounted in that apparatus is conventional. It includes two side plates joined by crossbeams which support upper and lower screens. With continuous use and with heavy loads dropped directly on the screen, heavy bending strains on the crossbeams were noted. Also, because of the extended width of the screens, continued shaking weakened the screens.

An object of the present invention is to provide added strength to a shaker screen assembly to make it better able to withstand extensive loading of heavy materials. A further object of the invention is to provide such a strengthened shaker assembly which does not unduly increase the complexity and weight of the shaker structure.

SUMMARY

A shaker assembly includes longitudinal side plates, crossbeams joining the side plates, a screen assembly, and a shaker mechanism. The crossbeams are staggered so as to be non-coplanar and a rigid longitudinal center plate parallel to the side plates joins the structural crossbeams. Forces applied to the screen assembly are transmitted through the center plate to the joined crossbeams so that weight which would otherwise be absorbed by a single crossbeam is absorbed by all the crossbeams. The strain on the single crossbeam is thereby reduced. The plate provides a longitudinal truss which reduces transverse bending.

The crossbeams lie in two planes with an upper screen resting on the beams in an upper plane and lower screens resting on lower beams.

The upper screen rests on longitudinal bars which in turn rest on the upper crossbeams. It is clamped to the center plate.

BRIEF DESCRIPTION OF THE DRAWINGS

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being place upon illustrating the principles of the invention.

DESCRIPTION OF A PREFERRED EMBODIMENT

Figure 1:
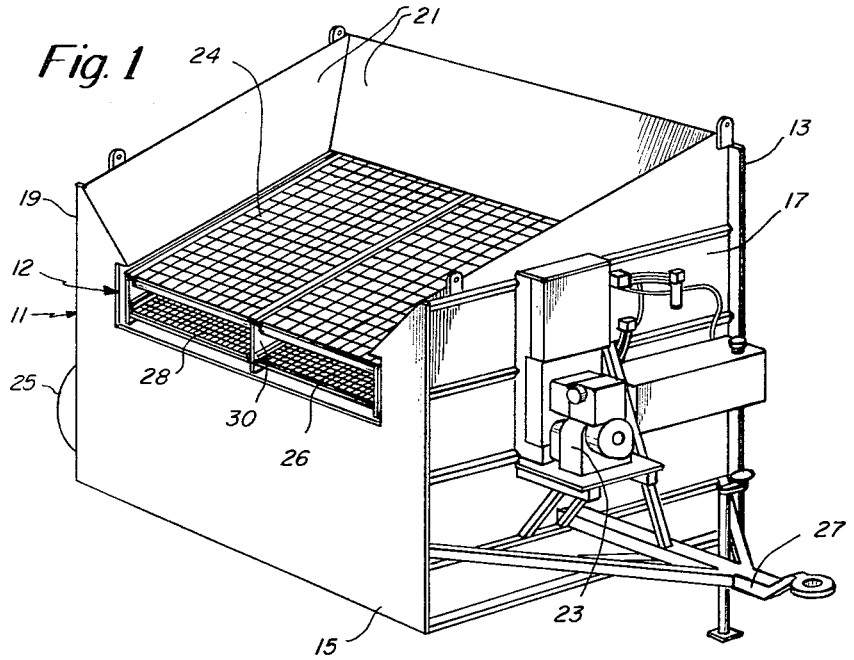
FIG. 1 is a front perspective view of a portable loam screening apparatus embodying the present invention.

As shown in FIG. 1 a loam separator has a box-like structural frame 11 having a generally rectangular horizontal cross section. The frame 11 has a tall rear end 13 a short front end 15 and sides 17 and 19. The front end 15 and sides 17 and 19 are closed while the tall end 14 is open as discussed in my prior application. The frame thus forms a three-sided enclosure the interior of which is open for receiving separated loam.

A funnel is formed at the top of frame 11 by funneling surfaces 21 which extend downwardly and inwardly from the upper edges of the tall end and the sides of the frame. A shaker assembly 12 is supported by the frame below the funneling surfaces 21. This shaker asembly extends to the upper edge of the short end 15.

Figure 2:
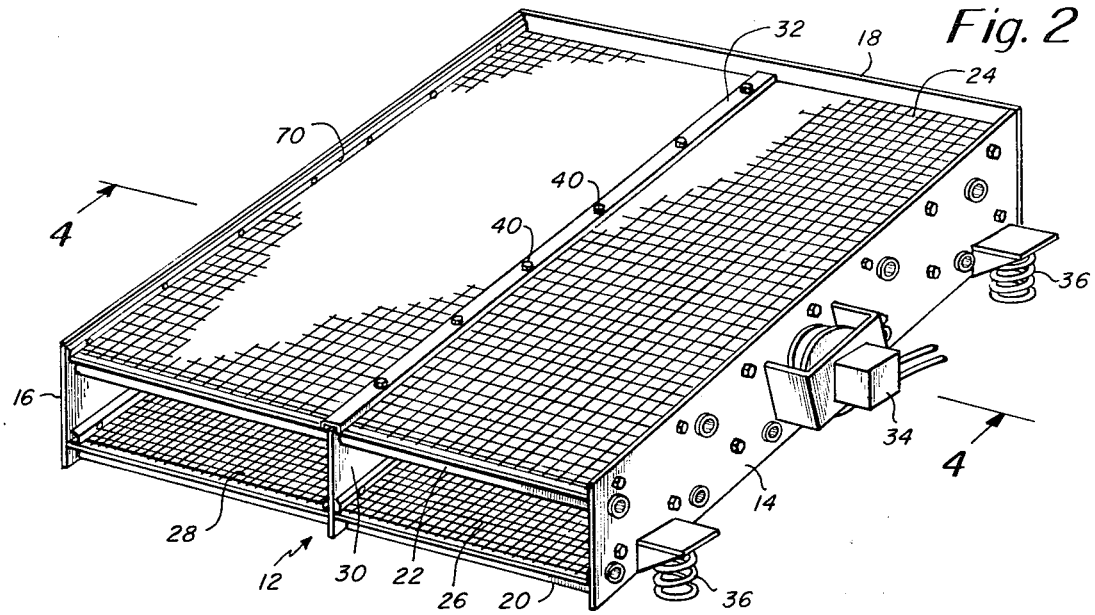
FIG. 2 is a prespective view of a shaker screen assembly used in the apparatus of FIG. 1.

The shaker assembly (FIG. 2) includes an upper screen 24 and lower screens 26 and 28 stretched between side plates 14 and 16. The upper screen 24 is of a mesh size which separates very coarse material from less coarse material and loam; and the lower screens 26 and 28 are of a finer mesh which separates the remaining coarse material from loam. It is shaken by an off-balance mechanism driven by a hydraulic motor 34. The coarse material rolls to the end of the assembly while the fine material passes into the frame 11.

The frame 11 has a one-cylinder diesel engine 23 mounted to one side thereof to pump hydraulic fluid for driving the motor 34. The frame also has collapsable wheels 25 mounted to the outer side 19 and a hitch 27 for towing the separator behind a vehicle.

The shaker assembly 12 includes longitudinal side plates 14 and 16 joined by a rear plate 18 and a number of crossbeams including angle irons 20 and 22. The upper screen 24 spans the space between the side plates 14 and 16. It is connected to each side plate and is clamped to a longitudinal center plate 30 by means of a clamping bar 32. Two lower screens 26 and 28 together span the space between the side plates 14 and 16. Each is connected to a side plate and the center plate 30.

Figure 3:
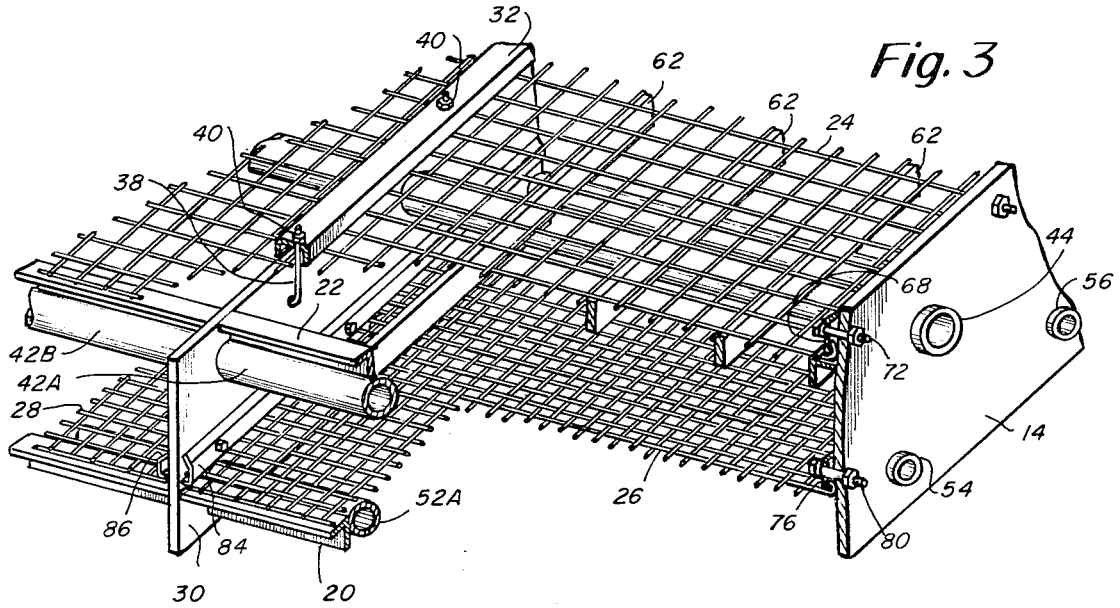
FIG. 3 is an enlarged view of the near corner of the assembly of FIG. 2, partially broken away.
Figure 4:
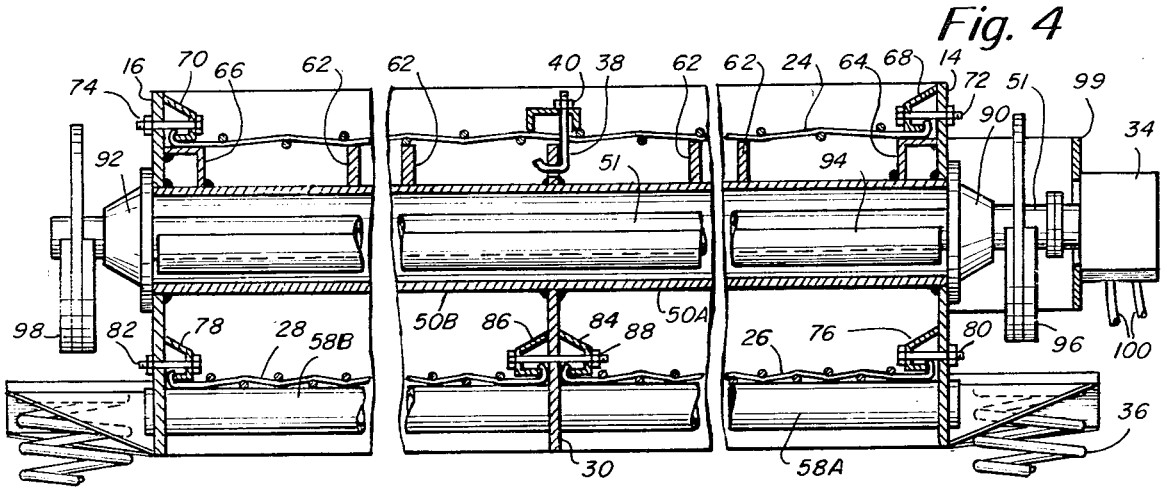
FIG. 4 is a cross-sectional view of the assembly of FIG. 2 taken along line 4—4.

As shown in FIGS. 3 and 4, the clamping bar 32 is held down against the center plate 30 by means of a series of hooks 38 which are inserted through holes in the plate 30. The hooks 38 also pass through holes in the clamping bar 32, and the bar is tightened down against the screen by nuts 40 on the threaded ends of the hooks.

As shown in FIGS. 3–6, the side plates 14 and 16 are joined by a series of crossbeam tubes which pass through close-fitting holes in the center plate 30 and side plates 14 and 16. The tubes are welded to each of the side plates and to the center plate. There are four upper tubes 42, 44, 46, 48 and 50 lying along an upper plane. The portions of the tubes to the right of the center plate are designated by an A after the reference numeral and the portions of the tubes to the left of the center plate are designated by a B. The center tube 50 is somewhat larger than the other upper tubes and encloses an off-balance shaft 51 to be described below. A second lower plane of tubes 52, 54, 56, 58 and 60 are staggered relative to the upper tubes. The lower tubes, somewhat smaller than the upper ones, also pass through close fitting holes in the center plate 30 and side plates 14 and 16, and the tubes are welded to each of the plates.

A number of longitudinal bars 62 rest on the upper crossbeam tubes and are welded to the end angle iron 22 and rear plate 18. These longitudinal bars have rubber pads thereon and serve as a support for the upper screen 24. Also supporting the screen 24 are angle irons 64 and 66 (FIG. 4) along respective side walls 14 and 16. The screen 24 is stretched into place by bolts and nuts 72 and 74 which, when tightened, pull clamps 68 and 80 outwardly. These clamps extend the entire length of the shaker assembly.

In a similar fashion, the two fine mesh screens 26 and 28 rest on the lower level of crossbeam tubes. Because the lower screens are not subjected to the heavier material carried away by the upper screen 24, longitudinal bars such as bars 62 are not required. Because of the tendency of prior screens to shake apart, two screens are used on the lower level and each is stretched between a side plate and the center plate 30. Clamps 76 and 78 stretch the respective screens toward the side plates with tightening of the bolts 80 and 82, and clamps 84 and 86 stretch the screens inwardly toward the plate 30 with tightening of the bolt 88.

The two screens 26 and 28 together provide the screening capacity of a single larger screen; but each is advantageously half the width of a wider screen and is securely fastened between a side plate and the center plate.

Figure 5:
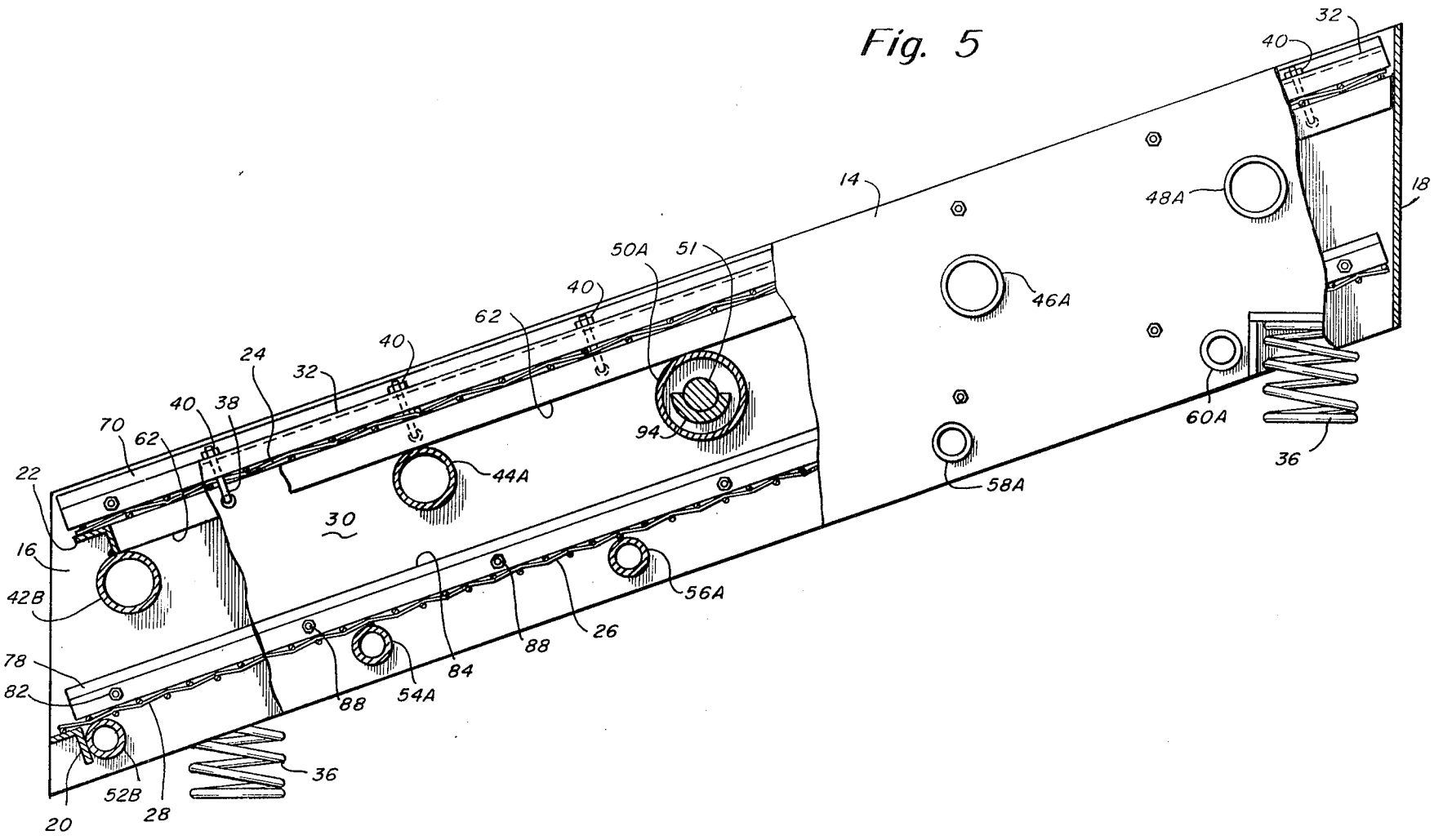
FIG. 5 is a side view of the assembly of FIG. 2 partially broken away.
Figure 6:
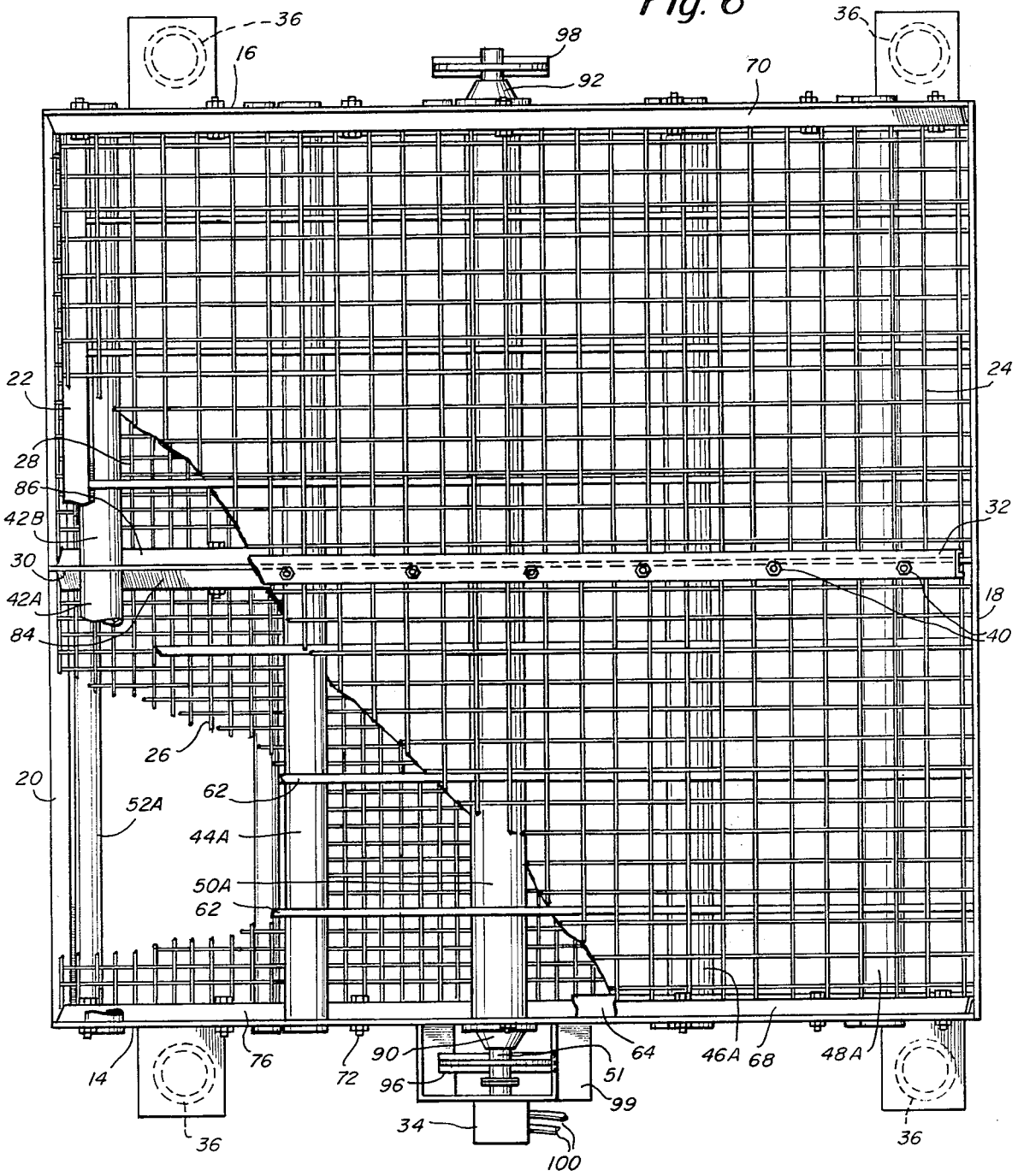
FIG. 6 is a plan view of the shaker assembly of FIG. 2 partially broken away.

The assembly 12 bounces on the springs 36 in a rotary movement through operation of an off-balance shaft mechanism best shown in FIG. 4. Bearing members 90 and 92 are fixed to respective side plates 14 and 16 and support the shaft 51 for rotary movement within tube 50. The shaft 51 has an off balancing weight 94 welded to one side thereof (FIG. 5). Also, off-balance flywheels 96 and 98 are fixed to the ends of the shaft 51. The hydraulic motor 43, mounted by a bracket 99 to the plate 14, drives the shaft 51. The resulting off balance rotary movement of the shaft causes the assembly 12 to shake on springs 36. The hydraulic driving fluid to the motor 34 is provided through lines 100.

In accordance with this invention, the shaker screen assembly is strengthened substantially by means of a single longitudinal plate. The longitudinal plate 30 strengthens the upper crossbeam tubes against transverse bending. It also provides a center support for both the upper screen 24 and for the lower screen segments 26 and 28. This center support reduces the width of each screen segment and thereby reduces the likelihood that any screen will be shaken apart.

Figure 7:
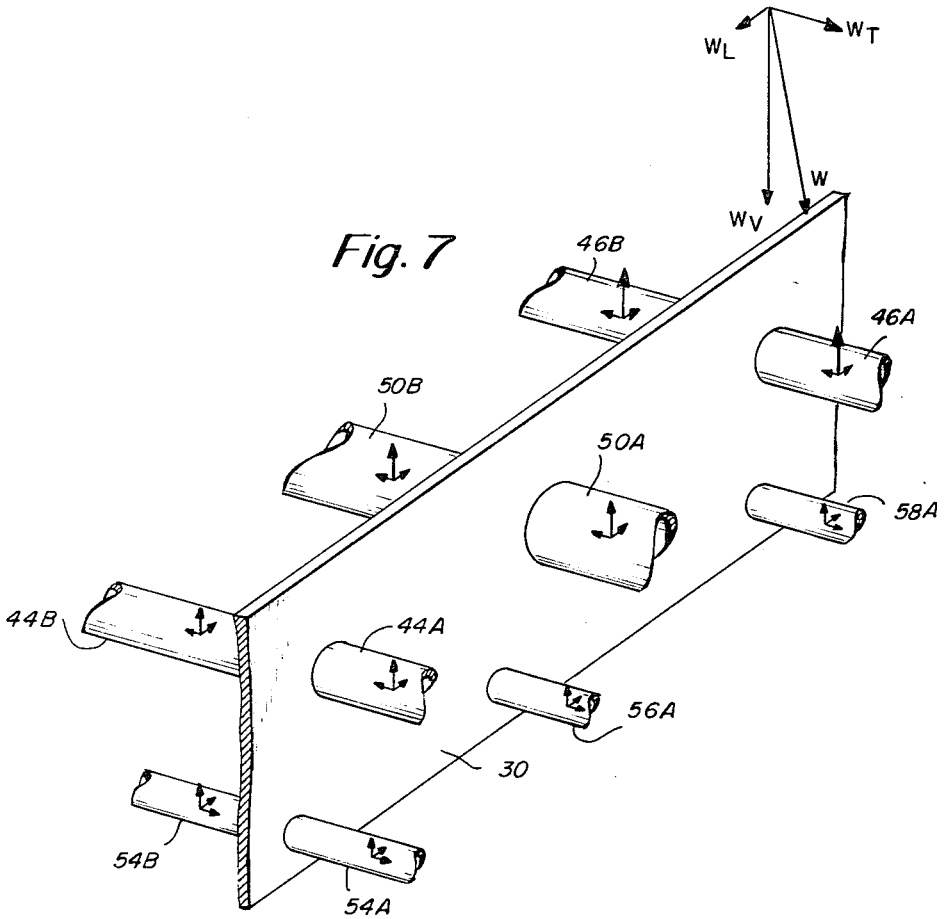
FIG. 7 is a force diagram illustrating the distribution of forces from the crossbeams to the center plate resulting from a single heavy weight on the plate.

The manner in which the forces of heavy objects are absorbed by all the structural tubes can be best seen in FIG. 7. Because the plate 30 is rigid it serves as a truss and transmits a large force W, having orthogonal components $W_L$, $W_T$, and $W_V$, throughout the length of the plate 30. The plate 30 transfers the force to the interconnected tubes which absorb the force as indicated by vectors. As a result, the bending force at the center of each tube is substantially reduced. The force W might actually be exerted on one of the bars 62. The force would then be transmitted through some upper tubes, and then through the plate 30 to the other tubes.

By staggering the tubes in two planes, an upper and a lower, any forces which tend to cause the plate 30 to twist from a vertical place are resisted. As shown in FIG. 7, the transverse component $W_T$ of any force of an object falling onto the screen assembly is resisted by the tubes with each tube section being either in compression or in tension. If the tubes were coplanar, a given segment of a tube would be placed in both tension and compression. This would result in a tearing action which would weaken if not destroy the welded joint between the tube and center plate 30.

While the invention has been particularly shown and described with reference to a preferred embodiment thereof, it will be understood by those skilled in the art that various changes in form and details may be made therein without departing from the spirit and scope of the invention as defined by the appended claims.

What is claimed is:

1. In a shaker assembly for separating fine material from coarse material comprising longitudinal side plates, structural cross beams joining the side plates, a screen assembly spanning the space between the side plates and supported by the cross beams, and means for shaking the plates, cross beams and screen assembly, the improvement of:

an upper screen assembly supported on an upper level of cross beams and a split lower screen assembly supported on a lower level of cross beams; and at least one rigid longitudinal center plate generally parallel to and between the side plates and joining the upper and lower levels of structural cross beams such that forces applied to the screen assembly are transmitted through the center plate to the joined cross beams.

2. The improvement in a shaker assembly as claimed in claim 1 wherein the upper screen assembly rests on longitudinal bars which rest on the upper beams.

3. The improvment in a shaker assembly as claimed in claim 1 wherein the upper screen assembly is a single upper screen clamped to the center plate.

4. The improvement in a shaker assembly as claimed in claim 1 wherein the cross beams are tubular.

* * * * *